US009132636B2

(12) United States Patent
Higuchi

(10) Patent No.: US 9,132,636 B2
(45) Date of Patent: Sep. 15, 2015

(54) LIQUID EJECTION HEAD AND PRODUCTION PROCESS THEREOF

(71) Applicant: CANON KABUSHIKI KAISHA, Tokyo (JP)

(72) Inventor: Hiroshi Higuchi, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/460,555

(22) Filed: Aug. 15, 2014

(65) Prior Publication Data

US 2015/0062253 A1 Mar. 5, 2015

(30) Foreign Application Priority Data

Sep. 2, 2013 (JP) ..... 2013-181148

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14145* (2013.01); *B41J 2/1603* (2013.01); *B41J 2/1607* (2013.01); *B41J 2/1628* (2013.01); *B41J 2/1629* (2013.01); *B41J 2/1631* (2013.01); *B41J 2/1639* (2013.01); *B41J 2/1642* (2013.01); *B41J 2/1645* (2013.01); *B41J 2/1648* (2013.01)

(58) Field of Classification Search

CPC ..... B41J 2/1628; B41J 2/1631; B41J 2/1639; B41J 2202/03; B41J 2/1606

USPC ..... 347/20, 54, 56, 63, 65; 29/890.1; 216/27

See application file for complete search history.

(56) References Cited

U.S. PATENT DOCUMENTS

| | | | | |
|---|---|---|---|---|
| 7,600,856 | B2 | 10/2009 | Lebens et al. | |
| 8,877,290 | B2 * | 11/2014 | Uyama | 427/248.1 |

* cited by examiner

*Primary Examiner* — An Do

(74) *Attorney, Agent, or Firm* — Fitzpatrick, Cella, Harper & Scinto

(57) ABSTRACT

A liquid ejection head includes a substrate and a flow path forming member on the substrate, the flow path forming member forming an ejection orifice from which a liquid is ejected and a liquid flow path. The flow path forming member is formed of an inorganic material, contains at least a flow path side wall portion forming a side of the liquid flow path and has a member covering a substrate side end part of an inner wall of the flow path side wall portion.

19 Claims, 5 Drawing Sheets

LIQUID EJECTION HEAD AND PRODUCTION PROCESS THEREOF

BACKGROUND OF THE INVENTION

1. Field of the Invention

The present invention relates to a liquid ejection head and a production process thereof.

2. Description of the Related Art

A variety of systems is proposed regarding a liquid ejection head which ejects a minute droplet at a desired position to form an image. A general liquid ejection head has a construction including an energy-generating element for generating energy for ejecting a liquid, a substrate having a circuit for driving the energy-generating element, an ejection orifice from which the liquid is ejected and a liquid flow path communicating with the ejection orifice. As an example of a process for producing the liquid ejection head having such a construction, there is mentioned a process in which a flow path forming member is directly formed by means of a photolithographic method on a substrate obtained by forming a circuit and an energy-generating element on a silicon wafer. In the flow path forming member of the liquid ejection head produced by such a process, there are limitations on material and thickness from the viewpoint of production. In addition, the flow path forming member is thinly formed from the viewpoint of achieving desired ejection characteristics, and the thickness thereof is generally from several microns to several tens microns. Therefore, the resistance of the flow path forming member to physical shock and vibration may be insufficient in some cases. Further, it may be difficult in some cases to thinly and evenly form the flow path forming member by means of the photolithographic method. For example, a pinhole or gap is formed in the flow path forming member, and so a liquid may leak from a liquid flow path in some cases.

In order to improve the long-term reliability of the liquid ejection head, various investigations have been made from a structural point of view. For example, U.S. Pat. No. 7,600,856 discloses a process in which another member is arranged at a position where no liquid flow path is formed, and a flow path forming member is formed thereon for enhancing the strength of the flow path forming member thinly formed from the viewpoint of a production process. According to this process, another member is filled into the flow path forming member except for a portion where the liquid flow path is formed, and the strength of the flow path forming member can be improved.

In the process described in U.S. Pat. No. 7,600,856, a gap is easily formed at a portion in particular where a side wall of the flow path forming member comes into contact with a substrate as illustrated in FIG. 6 (portion A in particular), and there is a possibility that a liquid may leak from a liquid flow path. That is, in U.S. Pat. No. 7,600,856, the flow path forming member is formed by means of a chemical vapor deposition (CVD) method so as to cover a mold material of the liquid flow path. However, it is however hard for the film-forming gas to reach a part where the mold material provided with a structurally narrow space comes into contact with the substrate. Therefore, the film forming rate at that part becomes low. As a result, a gap such as pinholes or cracks is easily formed in the flow path forming member at a part where the flow path forming member comes into contact with the substrate.

Even when a flow path forming member is formed of a resin, the flow path forming member may be detached from the substrate, or cracking may occur in the flow path forming member at a part coming into contact with the substrate in some cases. When the detachment or cracking occurs, a problem that a liquid leaks from a liquid flow path is caused.

Accordingly, it is an object of the present invention to provide a liquid ejection head capable of reducing liquid leakage from a liquid flow path.

SUMMARY OF THE INVENTION

According to the present invention, there is provided a liquid ejection head comprising a substrate and a flow path forming member on the substrate, the flow path forming member forming an ejection orifice from which a liquid is ejected and a liquid flow path, wherein the flow path forming member is formed of an inorganic material, contains at least a flow path side wall portion forming a side of the liquid flow path and has a member covering a substrate side end part of an inner wall of the flow path side wall portion.

According to the present invention, there is also provided a process for producing the above-described liquid ejection head, comprising the steps of:

(1) forming a material of the member on the substrate, (2) forming a sacrifice layer on the material of the member, (3) etching the sacrifice layer and the material of the member to form a flow path mold material having a flow path pattern of the liquid flow path and the member, and (4) forming the flow path forming member on the flow path mold material.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The liquid ejection head obtained by the present invention can be mounted in an apparatus such as a printer, a copying machine, a facsimile machine having a communicating system or a word processor having a printer section, and further in an industrial recording apparatus integrally combined with various processors. This liquid ejection head is used, whereby recording can be performed on various recording media such as paper, thread, fiber, leather, metal, plastic, glass, wood and ceramic. Incidentally, the term "recording" used in the present invention means not only providing an image having a meaning such as a letter or a figure to a recording medium, but also providing an image having no meaning such as a pattern. Further, the term "liquid" should be widely interpreted and means a liquid used in formation of, for example, an image, a design, a pattern and the like, processing of a recording medium, or treatment of an ink or a recording medium, by applying it on to the recording medium. The treatment of the ink or the recording medium means, for example, a treatment for improving the fixing ability of the ink by solidification or insolubilization of a coloring material in the ink applied to the recording medium, or improving recording quality, color developability or image durability.

In the following description, a liquid ejection head is described by mainly taking an ink jet recording head as an application example of the present invention. However, the application scope of the present invention is not limited thereto. In addition, the liquid ejection head of the present invention may also be applied to a liquid ejection head for production of a biochip or printing of an electronic circuit in addition to the ink jet recording head. Other application examples of the liquid ejection head include a head for production of a color filter.

Embodiments of the present invention will hereinafter be described with reference to the accompanying drawings. Incidentally, the specific names of substances and materials expressed in the following description are used for sufficiently explaining the embodiments, not particularly limiting the scope of the present invention.

Figure 1:
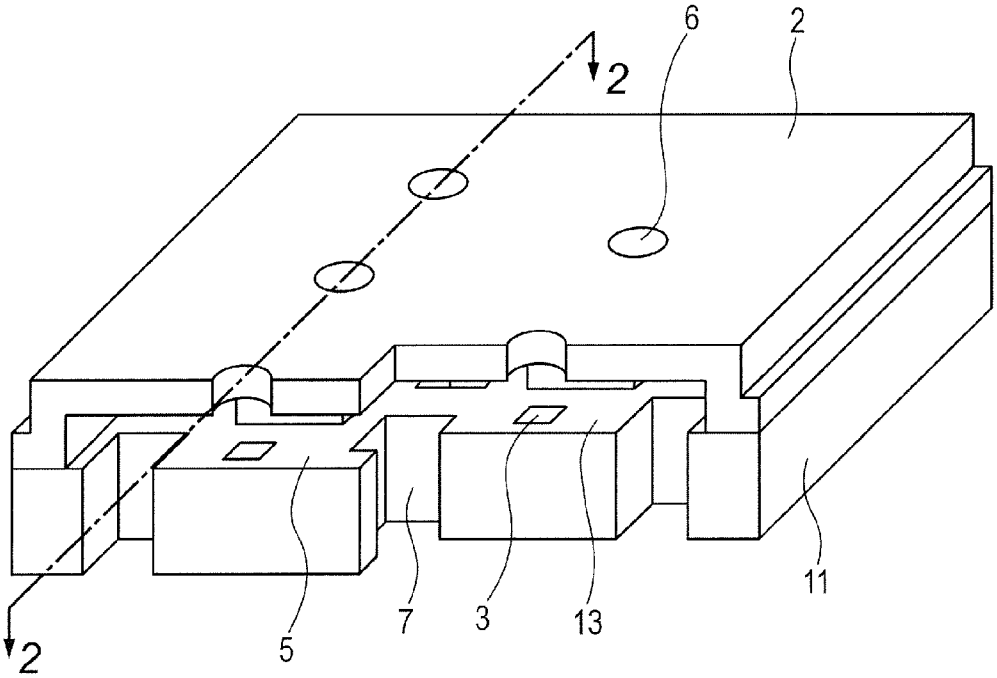
FIG. 1 is a schematic perspective view illustrating a constructional example of a liquid ejection head according to an embodiment of the present invention.
Figure 2:
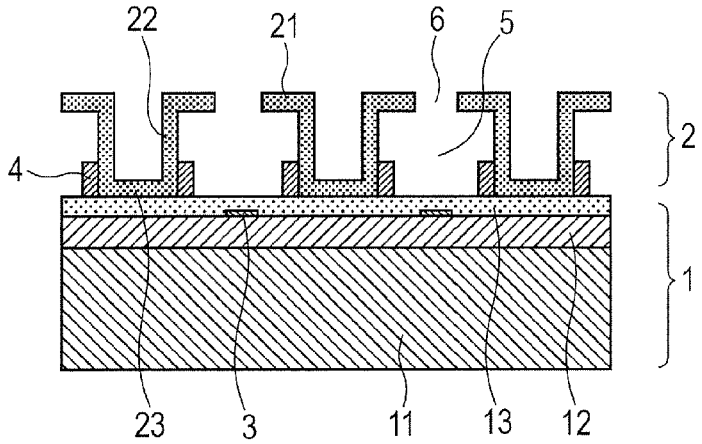
FIG. 2 is a schematic sectional view illustrating the exemplary construction of the liquid ejection head according to the embodiment.

FIG. 1 is a schematic perspective view illustrating a constructional example of a liquid ejection head according to this embodiment. FIG. 2 is a sectional view taken along the dotted line 2-2 in FIG. 1.

As illustrating in FIGS. 1 and 2, the liquid ejection head of this embodiment has a substrate 1 which has a plurality of energy-generating elements 3, and a flow path forming member 2 is formed on the substrate 1. As illustrated in FIG. 2, the substrate 1 has a base 11 such as a silicon substrate, an insulation film 12 formed on the base 11 and a protection film 13 formed on the insulation film 12. In addition, the substrate 1 may also include a circuit (not illustrated) for driving the energy-generating elements 3. In FIG. 2, the energy-generating elements 3 are provided on the insulation film 12 and covered with the protection film 13 to protect them.

In FIG. 1, the substrate 1 has a liquid supply port 7 for supplying a liquid such as an ink to a liquid flow path 5. The liquid supply port 7 is formed so as to pass through between a first surface (front surface) which is the side of the substrate where the energy-generating elements are arranged and a second surface (back surface) which is the opposite side to the first surface.

The flow path forming member 2 is arranged on the front surface of the substrate 1. The flow path forming member 2 may contain a flow path side wall portion 22 forming a side of the liquid flow path 5, a flow path upper wall portion 21 forming a top of the liquid flow path 5 and a substrate-contacting portion 23 in contact with the substrate 1. In addition, a partition wall is provided between energy-generating elements 3 adjoining each other as illustrated in FIGS. 1 and 2, and the flow path side wall portion 22 also contains a portion forming this partition wall.

The liquid ejection head of this embodiment has a member 4 covering a substrate side end part of an inner wall of the flow path side wall portion. The member 4 functions as a member for preventing liquid leakage from the liquid flow path. As illustrated in FIG. 2, the substrate side end part of the inner wall of the flow path side wall portion 22 forming the side of the liquid flow path is covered with the member 4. In the liquid ejection head, detachment or a gap is easily caused at a portion where the flow path forming member comes into contact with the substrate as described above. According to this embodiment, however, the liquid leakage can be prevented or reduced by covering the substrate side end part of the inner wall of the flow path side wall portion 22 with the member 4 even if such detachment or gap is caused.

The member 4 covers the substrate side end part of the inner wall of the flow path side wall portion 22. The member 4 is arranged in contact with the substrate and the inner wall of the flow path side wall portion. For example, the member 4 covers the inner wall portion within a range of at least 0.1 μm from the lower end of the inner wall. In addition, the member 4 is favorably provided over the substrate side end part in the whole inner wall of the flow path side wall portion 22. However, the effect of the present invention is exhibited even when the member 4 is provided at the substrate side end part of a part of the whole inner wall.

The flow path forming member 2 may contain a partition wall arranged between the energy-generating elements adjoining each other. In addition, the member 4 favorably covers the substrate side end part at least at a portion forming the partition wall of the inner wall of the flow path side wall portion.

The substrate 1 may contain a wiring for supplying electricity to the energy-generating element 3, a logic circuit for selectively driving the respective energy-generating elements 3 and a driver. In this case, the substrate 1 can be prepared by forming or mounting the wiring, the logic circuit and the driver on the base 11. For example, an Si wafer may be used as the base 11.

For example, a heating resistor, a piezoelectric body or a thermally deformable actuator may be used as the energy-generating element for ejecting a liquid from an ejection orifice 6. In addition, the energy-generating element is formed on the base and may also be formed so as to come into contact with the substrate. Further, the energy-generating element may be formed so as to be in a state of being floated in the liquid flow path 5. That is, the energy-generating element may float with respect to the substrate 1.

For the protection film 13 isolating the energy-generating element from a liquid flowing in the liquid flow path, a material hard to be dissolved in the liquid may be used. For example, silicon nitride may be used as such a material. When the energy-generating element is formed of a heating resistor, the protection film is favorably as thin as possible for efficiently ejecting the liquid. The protection film may be formed in a thickness of, for example, from 2,000 nm to 3,000 nm. In addition, a material low in dielectric constant is favorably used as the insulation film 12 for insulating between wirings on the base. For example, silicon oxide may be used as such a material.

The flow path forming member 2 is formed of an inorganic material. Examples of the inorganic material include SiN and SiC.

The flow path forming member 2 may be formed by the flow path upper wall portion 21, the flow path side wall portion 22 and the substrate-contacting portion 23 as described above. The flow path forming member 2 may be formed by a chemical vapor deposition (CVD) method or a physical vapor deposition (PVD) method. In addition, the film thickness of the flow path forming member can be arbitrarily set within a range satisfying liquid ejectability. A silicon-based inorganic material may be favorably used for the flow path forming member from the viewpoint of scarcely dissolving in or swelling with a liquid such as an ink. Incidentally, no particular limitation is imposed on the flow path side wall portion of the flow path forming member, and it may be formed either perpendicularly to the base or stepwise.

The member 4 covers the substrate side end part of the inner wall of the flow path side wall portion 22 as illustrated in FIG. 2. In addition, the member 4 covers the substrate side end part of the inner wall of the flow path side wall portion 22, whereby it comes into inevitable contact with the surface of the substrate 1. In other words, the member 4 is placed on a liquid flow path side of a bending part formed by the flow path side wall portion and the substrate-contacting portion of the flow path forming member.

When the flow path forming member is formed by the CVD method or the PVD method, the film-forming gas is hard to reach a region corresponding to the bending part, and so the film forming rate in this region becomes low. Therefore, a gap may be formed in the bending part in some cases. In this embodiment, the member 4 is thus placed on the liquid flow path side of this bending part, whereby the gap can be covered with the member 4 even if the gap is formed in the flow path forming member, so that liquid leakage from the liquid flow path does not occur.

Figure 4A:
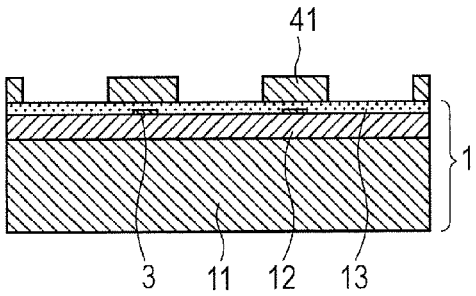
FIGS. 4A, 4B, 4C, 4D, 4E, 4F, 4G and 4H are schematic sectional views for explaining a production process of a liquid ejection head according to a second embodiment and Example 2.
Figure 4B:
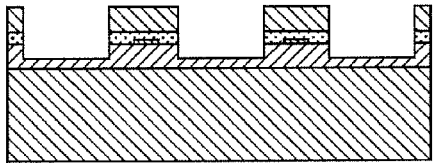
Figure 4C:
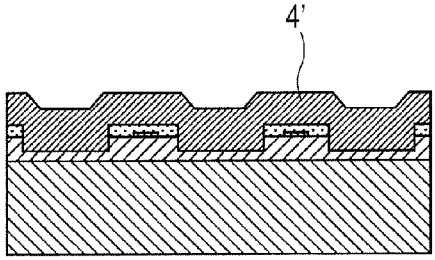
Figure 4D:
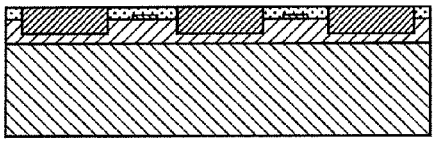
Figure 4E:
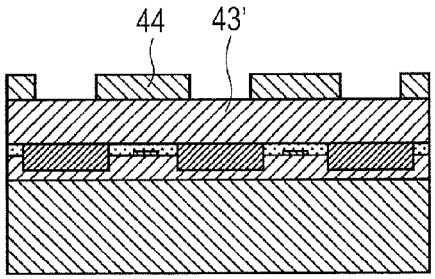
Figure 4F:
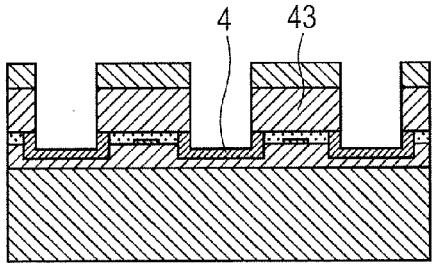
Figure 4G:
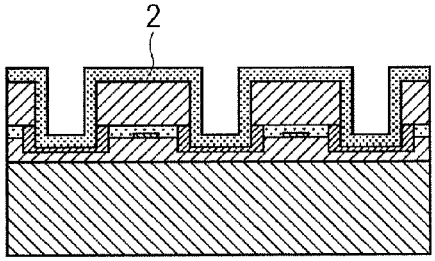
Figure 4H:
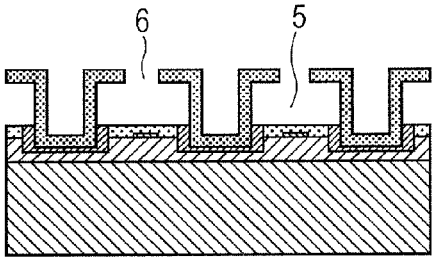

In addition, the substrate-contacting portion may also be formed at a position closer to the substrate than the bottom of the liquid flow path as illustrated in FIG. 4H to cover with the member 4. In other words, the member 4 is formed so as to be embedded in the first surface of the substrate, and the substrate-contacting portion is formed so as to be embedded in the member 4, whereby a substrate side end part region of the inner wall of the flow path side wall portion can be covered with the member 4. In particular, a substrate-contacting portion of a part corresponding to the partition wall favorably has such a structure. Even in this structure, liquid leakage does not occur because the gap comes into no contact with the liquid flow path. In the case of this structure, the member 4 can be arranged without reducing the capacity of the liquid flow path, and so advantage is given from the viewpoint of forming the liquid flow paths at a high density. In addition, this structure can also improve resistance to detachment because the substrate-contacting portion of the flow path forming member comes into contact with the member 4.

There is a tendency for a gap formed in the bending part to become larger or longer as the film thickness of the flow path forming member becomes thicker, so that the liquid flow path side of the bending part is favorably covered with the member 4 equally to or thicker than the thickness of the flow path forming member.

The member 4 may be formed of a single layer or plural layers.

No particular limitation is imposed on the material of the member 4, and examples thereof include silicon-based inorganic materials, metallic materials, ceramics and siloxanes. The material of the member 4 is desirably selected from materials which are good in adhesion to the flow path forming member, the protection film and the insulation film and neither dissolve in nor swell with a liquid, and the silicon-based inorganic materials and ceramics are favorable. Examples of the silicon-based inorganic materials include silicon oxide, silicon nitride and silicon carbide. Examples of the ceramics include aluminum oxide and titanium oxide. The material for the member 4 is favorably the same as the material of the flow path forming member, the protection film or the insulation film. For example, all of the flow path forming member, the protection film and the member 4 are formed with silicon nitride, whereby a highly reliable head with good adhesion and without dissolution into liquid can be prepared.

According to the construction of this embodiment, there can be provided a liquid ejection head by which liquid leakage can be prevented or reduced because a gap can be covered with the member 4 even if the gap is formed in the flow path forming member.

Figure 5A:
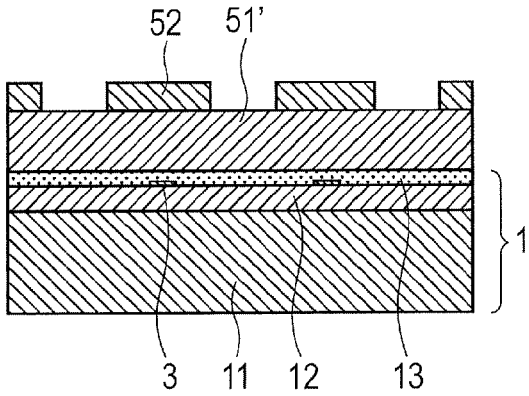
FIGS. 5A, 5B, 5C and 5D are schematic sectional views for explaining a production process of a liquid ejection head according to a third embodiment and Example 3.
Figure 5B:
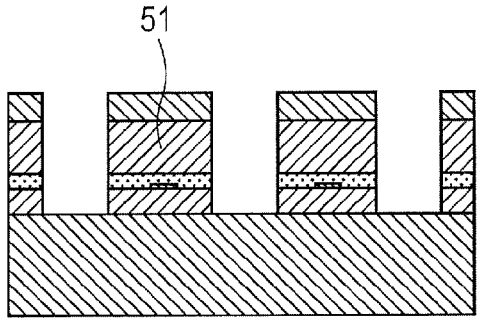
Figure 5C:
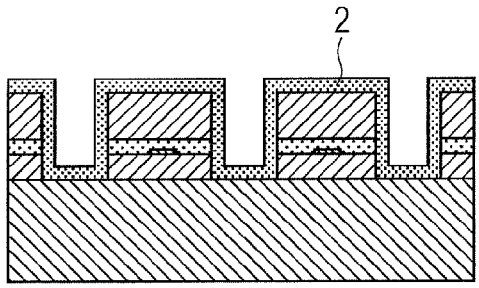
Figure 5D:
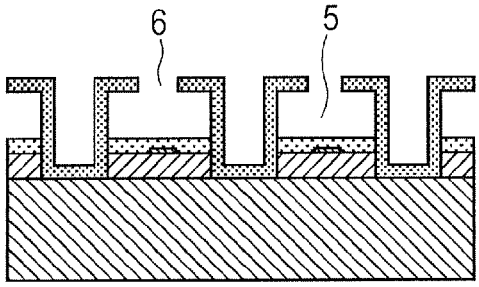
Figure 6:
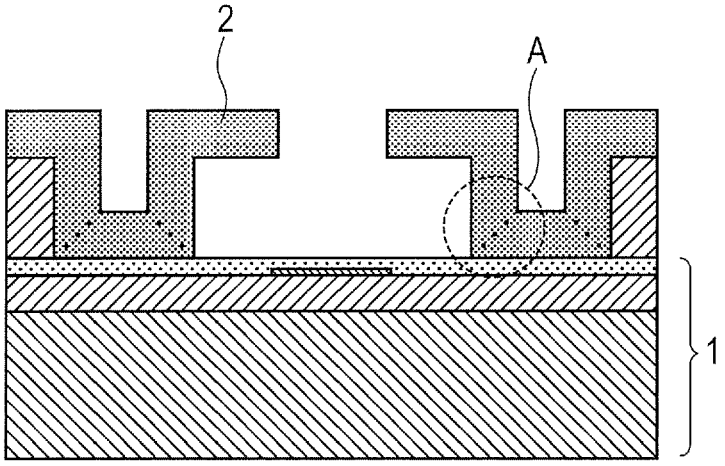
FIG. 6 is a schematic view for explaining a gap which forms the cause of liquid leakage.

In addition, at least one of the insulation film and the protection film formed on the base may also be used as the member 4 to cover the substrate side end part as illustrated in FIG. 5D. That is, the bending part is arranged at a position closer to the substrate side than the bottom of the liquid flow path, whereby the substrate side end part can be covered with the protection film or the insulation film.

A process for producing a liquid ejection head according to this embodiment will hereinafter be described. The production process according to this embodiment has the following steps: (1) a step of forming a material of a member 4 on a base or a substrate, (2) a step of forming a sacrifice layer (a layer formed of a material of a flow path mold material), (3) a step of etching the sacrifice layer and the material of the member 4 to form the flow path mold material having a flow path pattern of a liquid flow path and the member 4, (4) a step of forming a flow path forming member on the flow path mold material, (5) a step of forming a liquid supply port, and (6) a step of removing the flow path mold material.

The step of forming the material of the member 4 on the base or the substrate is described.

First, a material becoming the member 4 can be deposited on the base by a chemical vapor deposition (CVD) method or a physical vapor deposition (PVD) method. The film thickness of the material thus deposited is favorably set equally to or thicker than the thickness of the flow path forming member so as to sufficiently cover a gap possibly formed upon formation of the flow path forming member. Then, a mask pattern having a desired pattern is formed on the surface of the member 4 to conduct etching. The etching may be either wet etching or dry etching. When the member 4 is formed in such a structure as illustrated in FIG. 4H, a surface portion of the base at which the member 4 is arranged is first etched in advance to form a depressed portion. The material of the member 4 is then deposited on the whole surface of the base. CVD or PVD may also be used as a method for the deposition. However, an SOG material is favorably applied and arranged by a spinning method taking productivity and gap-filling performance into consideration. The surface of the material of the member 4 is then depressed while smoothing the surface until the protection film on the base is exposed. The depression may also be conducted by an etch-back method or a chemical mechanical polishing (CMP) method, and the CMP method is favorable because processing with more excellent flatness can be conducted.

The step of forming the sacrifice layer is described. No particular limitation is imposed on the sacrifice layer. However, the layer is desirably formed with a material which is neither decomposed nor altered at a film forming temperature of the flow path forming member and can be removed later. The material of the sacrifice layer may be either an organic material or an inorganic material. The sacrifice layer can be formed into a desired film thickness by suitably selecting a method such as spin coating, CVD or PVD according to a material used.

The step of etching the sacrifice layer and the material of the member 4 to form the flow path mold material having a flow path pattern of the liquid flow path and the member 4 is described. A mask pattern having the flow path pattern is formed on the surface of the sacrifice layer, whereby the sacrifice layer and the material of the member 4 can be etched collectively by, for example, reactive ion etching (RIE). In the etching, the sacrifice layer and the material of the member 4 are favorably etched collectively by RIE with high anisotropy for processing sections of the flow path mold material and the member 4 into sections which are continuous and free of a difference in level. The etching is conducted collectively by RIE, whereby a smooth section can be formed, and a gap is hard to be formed upon formation of the flow path forming member. The collective etching may be conducted by suitably using, for example, a fluorocarbon gas, an oxygen gas or an argon gas according to the materials of the sacrifice layer, the protection film and the insulation film.

The step of forming the flow path forming member on the flow path mold material is described. No particular limitation is imposed on a method for forming the flow path forming member. However, the flow path forming member is favorably formed by CVD or PVD. The flow path forming member may be formed so as to have an arbitrary film thickness according to a liquid ejection design. When CVD is used, for example, a monosilane gas and a nitrogen gas may be used as raw materials to form a silicon nitride film.

The step of forming the liquid supply port is described. The liquid supply port can be formed by, for example, conducting wet etching or dry etching from a back side of the base.

The step of removing the flow path mold material is described. This step may be conducted by a proper removal method according to the material of the sacrifice layer. For example, when the sacrifice layer is formed of an organic material, removal by asking with an oxygen radical may be adopted. In addition, when the sacrifice layer is formed of such a metal as to dissolve in an acidic solution, removal by wet etching may be adopted.

In addition, when at least one of the insulation film and the protection film of the substrate is combined with the member 4, the liquid ejection head can be prepared according to the following steps: (1) a step of forming a sacrifice layer on the substrate, (2) a step of etching at least one of the sacrifice layer, the protection film and the insulation film to form a flow path mold material having a flow path pattern of a liquid flow path, (3) a step of forming a flow path forming member, (4) a step of forming a liquid supply port, and (5) a step of removing the flow path mold material.

A mode of producing the liquid ejection head according to this embodiment is described with reference to FIGS. 3A to 5D.

First Embodiment

Figure 3A:
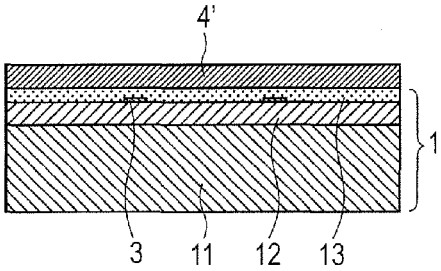
FIGS. 3A, 3B, 3C, 3D, 3E, 3F and 3G are schematic sectional views for explaining a production process of a liquid ejection head according to a first embodiment and Example 1.

A substrate 1 with an energy-generating element 3 provided on a front surface (first surface) as illustrated in FIG. 3A is first provided. The substrate 1 contains a base 11, an insulation film 12 arranged on the base, the energy-generating element 3 arranged on the insulation film 12 and a protection film 13 arranged so as to cover the energy-generating element 3. Incidentally, neither a circuit nor a wiring is illustrated in the drawings.

A member material 4' is then formed on the substrate 1. The thickness of the member material 4' is, for example, from 1 to 3 μm. For example, silicon oxide, silicon nitride or silicon carbide may be used as the member material 4'.

Figure 3B:
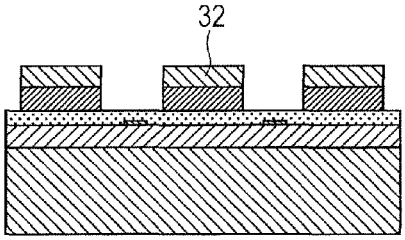

A mask pattern 32 is then formed on the member material 4' except a region inward narrower than that corresponding to a flow path pattern of a liquid flow path as illustrated in FIG. 3B. The mask pattern 32 may be provided on the member material 4' except a region inward narrower by 1 to 3 μm than that corresponding to the flow path pattern of the liquid flow path, for example. The member material 4' is etched by an etching method such as RIE (reactive ion etching) by using the mask pattern 32 as a mask until the protection film 13 is exposed. Thereafter, the mask pattern 32 is separated.

Figure 3C:
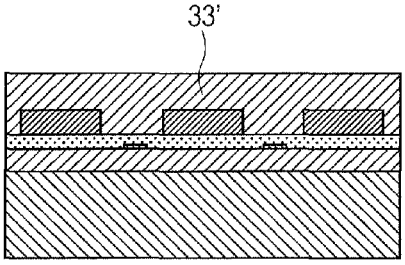

A layer 33' formed of a material of a flow path mold material is then formed on the substrate 1 and the member material 4' as illustrated in FIG. 3C.

Figure 3D:
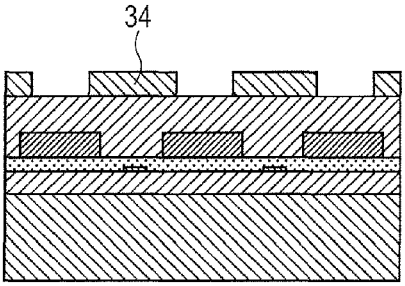

A mask pattern 34 having the flow path pattern of the liquid flow path is then formed on the layer 33' as illustrated in FIG. 3D.

Figure 3E:
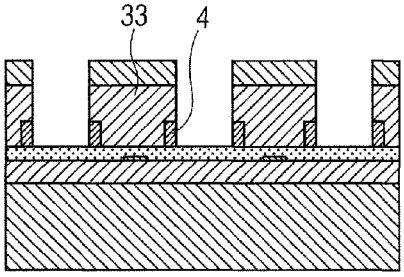

The layer 33' is then etched by an etching method such as RIE, and the member material 4' is successively etched to expose the protection film 13 of the substrate as illustrated in FIG. 3E. A flow path mold material 33 and a member 4 are thereby formed. Thereafter, the mask pattern 34 is separated.

Figure 3F:
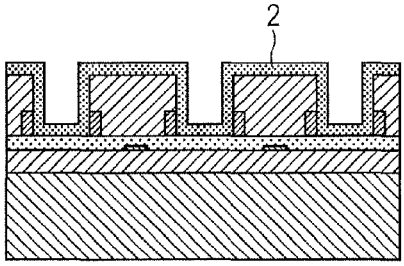

A flow path forming member 2 is then formed as illustrated in FIG. 3F. The flow path forming member 2 may be formed by, for example, a chemical vapor deposition method or a physical vapor deposition method.

Figure 3G:
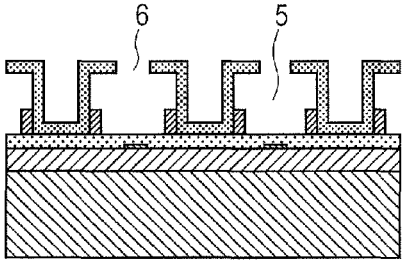

An ejection orifice 6 is then formed in the flow path forming member 2 as illustrated in FIG. 3G.

After the flow path forming member 2 is then covered with a protection member protecting the flow path forming member, a supply port for supplying a liquid to a liquid flow path is formed from a side of a back surface (second surface) of the base.

After the protection member is then removed, the flow path forming member 33 is decomposed and removed, thereby preparing a liquid ejection head.

Second Embodiment

A substrate 1 with an energy-generating element 3 provided on a front surface (first surface) as illustrated in FIG. 4A is first provided. A mask pattern 41 with a size inward smaller than that of a flow path pattern of a liquid flow path is formed on the substrate 1. The size of the mask pattern 41 may be set to be inward smaller by 1 to 3 μm than that of the flow path pattern of the liquid flow path, for example.

The protection film 13 is then etched by using the mask pattern 41 as a mask as illustrated in FIG. 4B. Upon the etching, the insulation film 12 may also be etched, and the etching may be stopped in the insulation film 12. Thereafter, the mask pattern 41 is separated. A first depressed portion is formed in the front surface (first surface) of the substrate 1 by this step.

A member material 4' is then arranged on the substrate 1 so as to be filled into the first depressed portion as illustrated in FIG. 4C.

The member material 4' is then polished until the protection film 13 is exposed as illustrated in FIG. 4D, thereby flattening the polished surface. An upper end surface of the member material 4' and the first surface of the substrate are thereby formed on the same plane.

A layer 43' formed of a material of a flow path mold material is then formed on the substrate 1 and the member material 4', and a mask pattern 44 having the flow path pattern of the liquid flow path is formed on the layer 43' as illustrated in FIG. 4E.

The layer 43' is then etched by an etching method such as RIE, and the member material 4' is successively etched as illustrated in FIG. 4F. Upon the etching of the member material 4', the etching may be either stopped in the middle of the member material 4' or conducted up to the lower end of the member material 4', that is, until the insulation film is exposed. A flow path mold material 43 and a member 4 are formed by this step. The member 4 is arranged in the first depressed portion formed in the first surface of the substrate, and a second depressed portion is formed in the member 4. Thereafter, the mask pattern 44 is separated.

The formation of a flow path forming member, the formation of an ejection orifice, the protection of the flow path forming member with a protection member, the formation of a liquid supply port and the removal of the flow path mold material are hereinafter conducted according to the same process as in the first embodiment to prepare a liquid ejection head illustrated in FIG. 4H.

Third Embodiment

A substrate 1 provided with an energy-generating element 3 as illustrated in FIG. 5A is first provided.

A layer 51' formed of a material of a flow path mold material is then formed. A mask pattern 52 having a liquid flow path pattern is successively formed on the layer 51'.

The layer 51' is then etched as illustrated in FIG. 5B, and a protection film 13 and an insulation film 12 of the substrate are successively etched until the etching reaches a base 11. Thereafter, the mask pattern 52 is separated.

A flow path forming member 2 is then formed on the substrate as illustrated in FIG. 5C. The flow path forming member can be formed by, for example, a chemical vapor deposition method or a physical vapor deposition method.

The formation of a liquid ejection orifice, the protection of the flow path forming member with a protection member, the formation of a liquid supply port and the removal of the flow path mold material are hereinafter conducted according to the same process as in the first embodiment to prepare a liquid ejection head illustrated in FIG. 5D.

Example 1

A substrate 1 with a heating resistor as an energy-generating element 3 provided on a front surface side as illustrated in FIG. 3A was first provided. The substrate 1 was prepared by forming an insulation film 12 on a base 11, arranging the energy-generating element 3 on the insulation film 12 and forming a protection film 13 so as to cover the energy-generating element 3. Incidentally, neither a circuit nor a wiring is illustrated in the drawings.

An SOG film 4' was then formed in a thickness of 3 μm on the substrate 1.

A mask pattern 32 was then formed with a positive resist on the SOG film 4' except a region inward narrower by 5 μm than that corresponding to a flow path pattern of a liquid flow path as illustrated in FIG. 3B. The SOG film 4' was etched by RIE using a fluorocarbon gas by using the mask pattern 32 as a mask until the protection film of the substrate was exposed. Thereafter, the mask pattern 32 was separated.

Non-photosensitive polyimide was then applied on to the substrate 1 and the SOG film 4' by spin coating as illustrated in FIG. 3C, and oven baking was conducted to perform dehydro-condensation, thereby forming a layer 33' formed of polyimide.

A positive resist was then applied on to the layer 33', and the positive resist was patterned by a photolithographic method, thereby forming a mask pattern 34 having the flow path pattern of the liquid flow path as illustrated in FIG. 3D.

The layer 33' was then etched by RIE using an oxygen gas, and the SOG film was successively etched with a fluorocarbon gas to expose the protection film 13 of the substrate as illustrated in FIG. 3E. A flow path mold material 33 and a member 4 were thereby formed. Thereafter, the mask pattern 34 was separated.

A flow path forming member 2 formed of silicon nitride was then formed on the substrate by a chemical vapor deposition method using monosilane and nitrogen gas as raw gasses as illustrated in FIG. 3F.

An ejection orifice 6 was then formed by photolithography (formation of a resist mask, etching and separation of the resist) as illustrated in FIG. 3G.

After the flow path forming member 2 was then covered with a protection member protecting the flow path forming member, a supply port for supplying a liquid to a liquid flow path was formed from a side of a back surface of the base.

After the protection member was then removed, the flow path mold material 33 was decomposed and removed by dry etching using an oxygen radical as a main reactive gas, thereby preparing a liquid ejection head.

According to the head thus prepared, a portion of the flow path forming member where a gap is easily formed upon the formation of the flow path forming member, i.e., a bending part between a flow path side wall portion and a substrate-contacting portion is covered with the member 4 formed of the SOG film. Therefore, the liquid flow path does not communicate with the gap, so that liquid does not leak from the gap during the operation of the liquid ejection head.

The liquid ejection head prepared by this example was driven over a long period of time. As a result, liquid leakage from the liquid flow path was not observed, and ejection characteristics were also stable. It was thus confirmed that the liquid ejection head is excellent in long-term reliability.

Example 2

A substrate 1 with a heating resistor as an energy-generating element 3 provided on a front surface side as illustrated in FIG. 4A was first provided. A mask pattern 41 having a size inward smaller by 5 μm than that of a flow path pattern of a liquid flow path was formed on the substrate 1. A positive resist was used for the mask pattern 41.

The protection film 13 and the insulation film 12 were then etched by reactive ion etching (RIE) using the mask pattern 41 as a mask as illustrated in FIG. 4B. The etching was stopped in the insulation film 12. Thereafter, the mask pattern 41 was separated. A depressed portion was formed in the front surface (first surface) of the substrate 1 by this step.

An SOG film 4' was then formed on the substrate so as to be filled into the depressed portion as illustrated in FIG. 4C.

The SOG film 4' was then subjected to chemical mechanical polishing (CMP) until the protection film 13 was exposed as illustrated in FIG. 4D, thereby flattening the polished surface.

Non-photosensitive polyimide was then applied on to the substrate 1 and the SOG film 4' by spin coating as illustrated in FIG. 4E, and oven baking was conducted to perform dehydro-condensation, thereby forming a layer 43' formed of polyimide. A positive resist was then applied on to the layer 43', and the positive resist was patterned by a photolithographic method, thereby forming a mask pattern 44 having the flow path pattern of the liquid flow path.

The layer 43' was then etched by RIE using an oxygen gas as illustrated in FIG. 4F, and the SOG film 4' was successively etched with a fluorocarbon gas. The etching of the SOG film 4' was stopped in the middle of the SOG film 4'. A flow path mold material 43 and a member 4 were formed by this step. Thereafter, the mask pattern 44 was separated.

The formation of a flow path forming member, the formation of an ejection orifice, the protection of the flow path forming member with a protection member, the formation of a liquid supply port and the removal of the flow path mold material are hereinafter conducted according to the same process as in Example 1 to prepare a liquid ejection head illustrated in FIG. 4H.

According to the head thus prepared, the member 4 is present on a liquid flow path side of a bending part between a flow path side wall portion and a substrate-contacting portion as in Example 1, so that the liquid flow path does not communicate with a gap even if the gap is formed at the bending part. Accordingly, liquid does not leak from the gap during the operation of the liquid ejection head. In addition, the member 4 is not placed in the liquid flow path but embedded in the substrate, so that the liquid flow paths can be formed at a high density without reducing the capacity of the liquid flow path.

The liquid ejection head prepared in this manner was driven over a long period of time. As a result, liquid leakage from the liquid flow path was not observed, and ejection characteristics were also stable. It was thus confirmed that the liquid ejection head is excellent in long-term reliability.

Example 3

A substrate 1 provided with a heating resistor as an energy-generating element 3 as illustrated in FIG. 5A was first provided.

Non-photosensitive polyimide was then applied on to the substrate by spin coating, and oven baking was conducted to perform dehydro-condensation, thereby forming a layer 51' formed of polyimide. A positive resist was then applied on to the layer 51', and the positive resist was patterned by a photolithographic method, thereby forming a mask pattern 52 having a liquid flow path pattern.

The layer 51' was then etched by RIE using an oxygen gas as illustrated in FIG. 5B, and the protection film 13 and the insulation film 12 of the substrate were then etched with a fluorocarbon gas until the etching reached the base 11. Thereafter, the resist was separated.

A flow path forming member 2 formed of silicon nitride was then formed on the substrate by a chemical vapor deposition method using monosilane and nitrogen gas as raw gasses as illustrated in FIG. 5C.

The formation of a flow path forming member, the protection of the flow path forming member with a protection member, the formation of a liquid supply port and the removal of the flow path mold material are hereinafter conducted according to the same process as in Example 1 to prepare a liquid ejection head illustrated in FIG. 5D.

According to the head thus prepared, a liquid flow path side of a bending part between a flow path side wall portion and a substrate-contacting portion is covered with the protection film and the insulation film of the substrate, so that a gap does not communicate with the liquid flow path even if the gap is formed at the bending part. That is, liquid does not leak from the gap during the operation of the liquid ejection head.

The liquid ejection head prepared in this manner was driven over a long period of time. As a result, liquid leakage from the liquid flow path was not observed, and ejection characteristics were also stable. It was thus confirmed that the liquid ejection head is excellent in long-term reliability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-181148, filed Sep. 2, 2013, which is hereby incorporated by reference herein in its entirety.

What is claimed is:

1. A liquid ejection head comprising a substrate and a flow path forming member on the substrate, the flow path forming member forming an ejection orifice from which a liquid is ejected and a liquid flow path, wherein the flow path forming member is formed of an inorganic material and includes at least a flow path side wall portion forming a side of the liquid flow path, and wherein at least a substrate side end part of an inner wall of the flow path side wall portion is covered with a member, the inner wall being a wall of the flow path side wall portion on the side of the liquid flow path.

2. The liquid ejection head according to claim 1, wherein the member is a member for preventing liquid leakage from the liquid flow path.

3. The liquid ejection head according to claim 1, wherein the member is arranged in contact with the substrate and the inner wall of the flow path side wall portion.

4. The liquid ejection head according to claim 1, wherein the member covers an inner wall portion within a range of at least 0.1 μm from a lower end of the inner wall.

5. The liquid ejection head according to claim 1, wherein the member is formed on a first surface of the substrate.

6. The liquid ejection head according to claim 1, wherein the substrate side end part of the inner wall is arranged in a first depressed portion formed in a first surface of the substrate.

7. The liquid ejection head according to claim 6, wherein the member is arranged in the first depressed portion, and the substrate side end part of the inner wall is arranged in a second depressed portion provided in the member.

8. The liquid ejection head according to claim 7, wherein an upper end surface of the member and the first surface of the substrate are arranged on the same plane.

9. A process for producing the liquid ejection head according to claim 8, comprising the steps of:

(1) forming the first depressed portion in the substrate, (2) forming a material of the member on the substrate containing the first depressed portion, (3) depressing the surface of the material of the member until the first surface of the substrate is exposed, (4) forming a sacrifice layer on the material of the member and the substrate, (5) etching the sacrifice layer and the material of the member to form a flow path mold material having a flow path pattern of the liquid flow path and the member having the second depressed portion, and (6) forming the flow path forming member on the flow path mold material.

10. The process according to claim 9, wherein in the step (5), the sacrifice layer and the material of the member are etched collectively by reactive ion etching.

11. The liquid ejection head according to claim 6, wherein the substrate has a base and at least one of an insulation film and a protection film formed on the base, and at least one of the insulation film and the protection film covers the substrate side end part of the inner wall as the member.

12. A process for producing the liquid ejection head according to claim 11, comprising the steps of:

(1) forming a sacrifice layer on the substrate, (2) etching the sacrifice layer and at least one of the protection film and the insulation film to form a flow path mold material having a flow path pattern of the liquid flow path and the first depressed portion, and (3) forming the flow path forming member on the flow path mold material.

13. The process according to claim 12, wherein in the step (2), the sacrifice layer and at least one of the protection film and the insulation film are etched collectively by reactive ion etching.

14. The liquid ejection head according to claim 1, wherein the substrate has a plurality of energy-generating elements for generating energy for ejecting the liquid, and the flow path forming member contains a partition wall arranged between the energy-generating elements adjoining each other, and the member covers the substrate side end part at least at a portion forming the partition wall of the inner wall of the flow path side wall portion.

15. The liquid ejection head according to claim 1, wherein the flow path forming member is formed of at least one of SiN and SiC.

16. The liquid ejection head according to claim 15, wherein the flow path forming member is formed by a chemical vapor deposition method or a physical vapor deposition method.

17. The liquid ejection head according to claim 1, wherein the flow path forming member and the member are formed of the same material.

18. A process for producing the liquid ejection head according to claim 1, comprising the steps of:

(1) forming a material of the member on the substrate, (2) forming a sacrifice layer on the material of the member, (3) etching the sacrifice layer and the material of the member to form a flow path mold material having a flow path pattern of the liquid flow path and the member, and (4) forming the flow path forming member on the flow path mold material.

19. The process according to claim 18, wherein in the step (3), the sacrifice layer and the material of the member are etched collectively by reactive ion etching.

* * * * *